US006494058B2

(12) United States Patent
Cho et al.

(10) Patent No.: US 6,494,058 B2
(45) Date of Patent: Dec. 17, 2002

(54) PLATE TYPE CONDENSER

(75) Inventors: Kyung-il Cho, Seoul (KR); Byeoung Ju Ha, Kyungki-do (KR); In-seob Song, Kyungki-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/682,605

(22) Filed: Sep. 26, 2001

(65) Prior Publication Data

US 2002/0083734 A1 Jul. 4, 2002

(30) Foreign Application Priority Data

Dec. 29, 2000 (KR) ..... 00-86370

(51) Int. Cl.[7] ..... F25B 39/04; F25B 41/06
(52) U.S. Cl. ..... 62/509; 62/511
(58) Field of Search ..... 62/507, 509, 506, 62/511; 165/135

(56) References Cited

U.S. PATENT DOCUMENTS 1,359,460 A * 11/1920 Kleist ..... 62/509
2,046,894 A * 7/1936 Candor ..... 62/507
2,199,413 A * 5/1940 Patrignani ..... 62/509
2,260,807 A * 10/1941 Hintze et al. ..... 62/508
2,768,508 A * 10/1956 Guyton ..... 62/507
5,033,540 A * 7/1991 Tategami et al. ..... 165/135
6,209,348 B1 * 4/2001 Shinmura et al. ..... 62/509

* cited by examiner

*Primary Examiner*—William C. Doerrler
(74) *Attorney, Agent, or Firm*—Burns, Doane, Swecker & Mathis, L.L.P.

(57) ABSTRACT

A plate type condenser used in a cooling system is provided. The plate type condenser includes a casing for defining an upper space into which a gaseous refrigerant flows and is cooled, a lower space for accommodating a liquid refrigerant into which the gaseous refrigerant is condensed, and a connecting portion through which the upper and lower spaces communicate with each other. The casing substantially has a plate shape. A refrigerant inlet is installed at an upper portion of the casing to communicate with the upper space. A refrigerant outlet is installed at a lower portion of the casing to communicate with the lower space. A first adiabatic slit for separating the walls of the casing is formed between the upper space and the lower space except at the connecting portion. Accordingly, since the first adiabatic slit prevents heat in the upper space from being conducted to the lower space through the walls of the casing, a liquid refrigerant in the lower space can be satisfactorily cooled without using an additional subcooler.

20 Claims, 8 Drawing Sheets

FIG. 4A
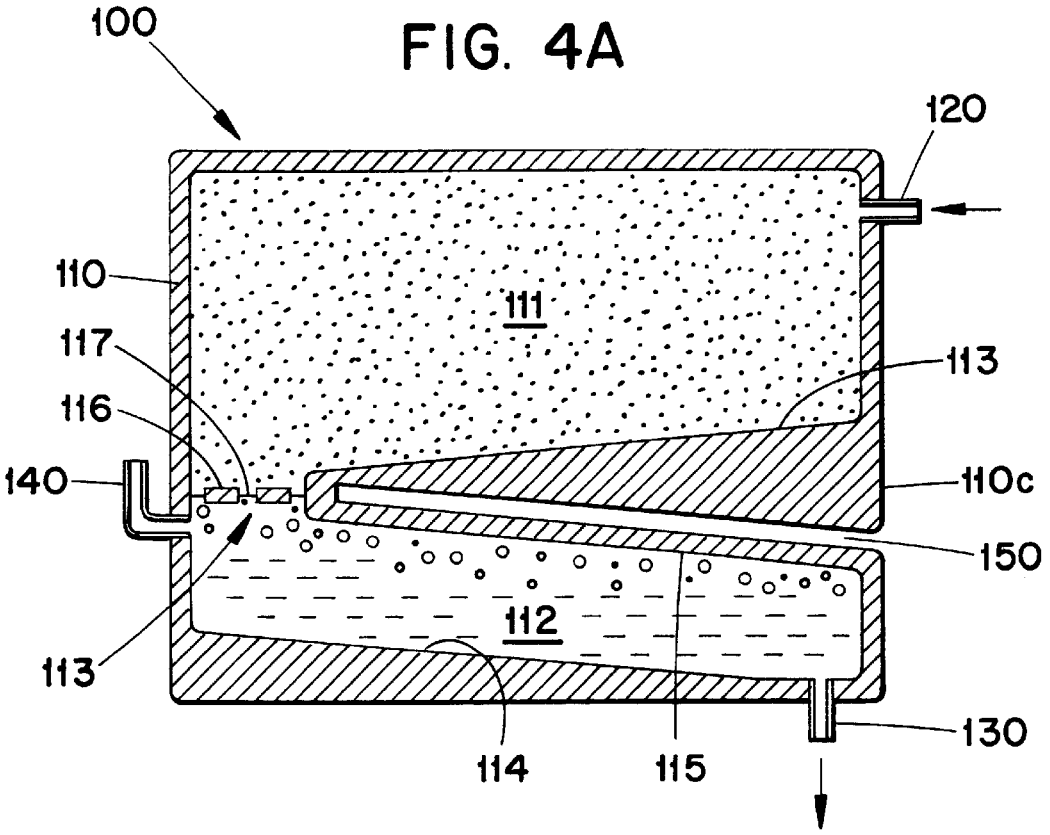
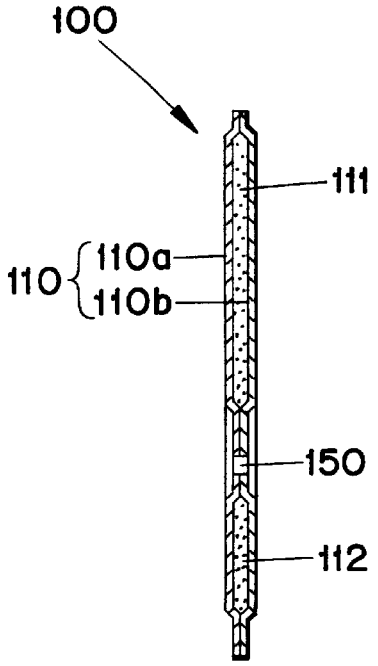
FIG. 4B

PLATE TYPE CONDENSER

BACKGROUND OF THE INVENTION

1. Field of the Invention

The present invention relates to a plate type condenser, and more particularly, to a plate type condenser having a structure in which a condensed liquid refrigerant can be cooled more effectively.

2. Description of the Related Art

Recently, with the ongoing development of electronic technology, electronic equipment is being made into modules which are becoming increasingly smaller and more powerful and thus give off more heat per unit area. Consequently, cooling has become an essential factor that should be considered when electronic equipment is designed or managed. There are many methods, such as heat conduction, natural convection, natural radiation, forced convection, cooling by means of liquid, immersion cooling, and heat pipe, for controlling temperature in electronic equipment. Recently, cooling methods using a capillary pumped loop have been researched.

Among cooling systems which can be applied to electronic equipment, a phase change cooling system usually includes an evaporator for evaporating a liquid refrigerant by causing the refrigerant to absorb heat radiated from a heat source, and a condenser for condensing the gaseous refrigerant by allowing the heat of the gaseous refrigerant to be radiated outward. Here, it is important to the performance of the entire system to maintain the temperature of the refrigerant condensed by the condenser satisfactorily low until the refrigerant returns to the evaporator.

FIG. 1 is a schematic perspective view of the exterior of a conventional condenser. As shown in FIG. 1, such a conventional condenser 10 includes a refrigerant tube 11 in which a refrigerant flows and a plurality of thin radiating plates 12 provided around the refrigerant tube 11. Generally, the refrigerant tube 11 is formed by bending a tube of small diameter multiple times in order to increase cooling efficiency. In this conventional condenser 10, when a gaseous refrigerant enters one end and flows through the refrigerant tube 11, heat is radiated outward through the heat radiating plates 12. Thus, the refrigerant is cooled and condensed. The condensed liquid refrigerant is discharged through the other end of the refrigerant tube 11.

However, in a cooling system using the condenser 10 having such a structure, since the condensed liquid refrigerant is not satisfactorily subcooled in the refrigerant tube 11, an additional subcooler for subcooling the liquid refrigerant should be provided, and a reservoir for temporarily containing the liquid refrigerant to discharge uncondensed gas contained in the liquid refrigerant also should be provided. As described above, since a phase change cooling system using the conventional condenser 10 needs a subcooler and a reservoir in addition to the condenser 10, the volume of the cooling system is large. Moreover, it is difficult to install the cooling system in a narrow space in small and compact electronic equipment due to the three-dimensional shape of the condenser 10.

To solve the above problem, plate type condensers which can be easily installed even in a narrow space have been proposed. FIG. 2 shows an example of a conventional plate type condenser. Referring to FIG. 2, a plate type condenser 20 is composed of a casing 21 for defining an inner space with a very small width. A refrigerant inlet 22 for allowing a gaseous refrigerant to flow in is installed at one upper end of the casing 21. A refrigerant outlet 23 for discharging a liquid refrigerant is installed at the opposite lower end of the casing 21. In this plate type condenser 20, a gaseous refrigerant, which flows into the casing 21 through the refrigerant inlet 22, is cooled and condensed by radiating heat through the walls of the casing 21 which are formed of a heat conductive material. The condensed liquid refrigerant is gathered in the lower portion of the casing 21 and discharged through the refrigerant outlet 23. In a cooling system using the above condenser 20, since uncondensed gas contained in the liquid refrigerant can be discharged while the liquid refrigerant is stagnant in the lower portion of the casing 21, a reservoir is not necessary. In addition, since the condenser 20 is very thin, the cooling system can be easily installed in a narrow space.

However, in this conventional plate type condenser 20, heat is conducted from the upper portion of the walls of the casing 21, which is heated by a high temperature gaseous refrigerant flowing in the casing 21, to the lower portion of the walls thereof. Because the casing 21 is formed of a material having an excellent heat conductivity in order to efficiently cool a refrigerant, a problem caused by heat conduction can easily occur. As a result, many conventional cooling systems using the conventional plate type condenser 20 employ a subcooler for cooling a liquid refrigerant discharged from the condenser 20 in order to satisfactorily secure the cooling performance of the system.

SUMMARY OF INVENTION

To solve the above problems, it is an object of the present invention to provide a plate type condenser including an adiabatic slit for suppressing heat conduction from the upper portion of a casing to the lower portion thereof in order to satisfactorily cool a condensed liquid refrigerant.

Accordingly, to achieve the above object of the invention, there is provided a plate type condenser including a casing defining an upper space in which a gaseous refrigerant flows and is cooled, a lower space for accommodating a liquid refrigerant into which the gaseous refrigerant is condensed, and a connecting portion through which the upper and lower spaces communicate with each other, the casing substantially having a plate shape; a refrigerant inlet through which the gaseous refrigerant flows into the upper space, the refrigerant inlet being installed at an upper portion of the casing to communicate with the upper space; a refrigerant outlet through which the liquid refrigerant in the lower space is discharged, the refrigerant outlet being installed at a lower portion of the casing to communicate with the lower space; and a first adiabatic slit for separating the walls of the casing between the upper space and the lower space except at the connecting portion, in order to suppress heat conduction from the upper space to the lower space.

Preferably, the upper space is a refrigerant path formed in zig-zag from the refrigerant inlet to the connecting portion or a refrigerant path which winds back and forth from the refrigerant inlet to the connecting portion. A second adiabatic slit for separating the walls of the casing may be formed between at least one pair of adjacent upper and lower portions of the refrigerant path. When the refrigerant path winds back and forth, a plurality of vertical passages may be formed between adjacent upper and lower portions of the refrigerant path substantially in a vertical direction.

Preferably, the refrigerant inlet and the refrigerant outlet are disposed at the same end of the casing, and the connecting portion is disposed near an end of the casing opposite to the end at which the refrigerant inlet and the refrigerant outlet are disposed.

In addition, it is preferable that the first adiabatic slit ascends from one end of the casing toward the connecting portion.

Preferably, a plurality of holes are formed in the connection portion.

According to the present invention, since the first adiabatic slit prevents heat in the upper space from being conducted to the lower space through the walls of the casing, a liquid refrigerant in the lower space can be satisfactorily cooled without using an additional subcooler.

BRIEF DESCRIPTION OF DRAWINGS

The above objective and advantages of the present invention will become more apparent by describing in detail preferred embodiments thereof with reference to the attached drawings in which:

FIG. 4A is a coplanar sectional view of the plate type condenser of FIG. 3;

FIG. 4B is a sectional view of the plate type condenser of FIG. 3, taken along the line A—A;

DETAILED DESCRIPTION

Hereinafter, embodiments of a plate type condenser according to the present invention will be described in detail with reference to the attached drawings. The present invention is not restricted to the following embodiments. The embodiments of the present invention are provided in order to more completely explain the present invention to anyone skilled in the art.

Figure 1:
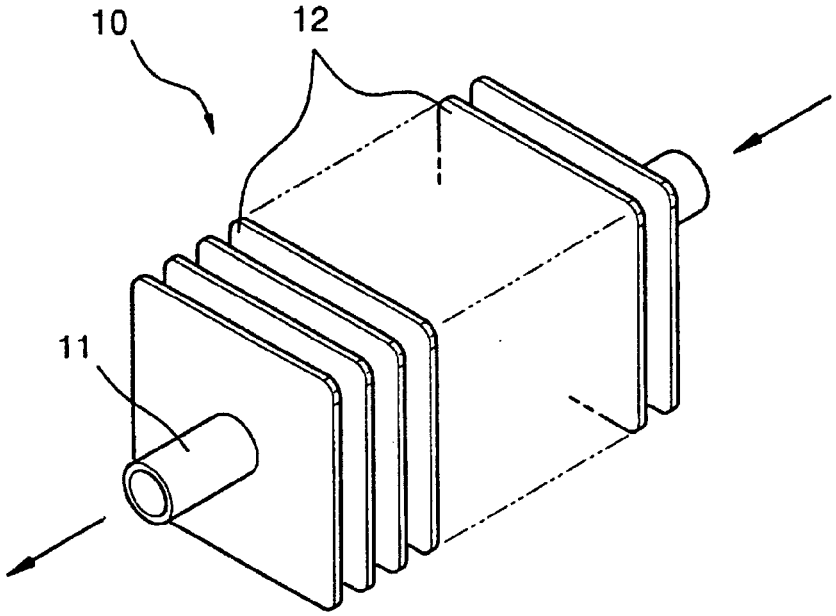
FIG. 1 (PRIOR ART)
FIG. 1 is a schematic perspective view of the exterior of a conventional general condenser.
Figure 2:
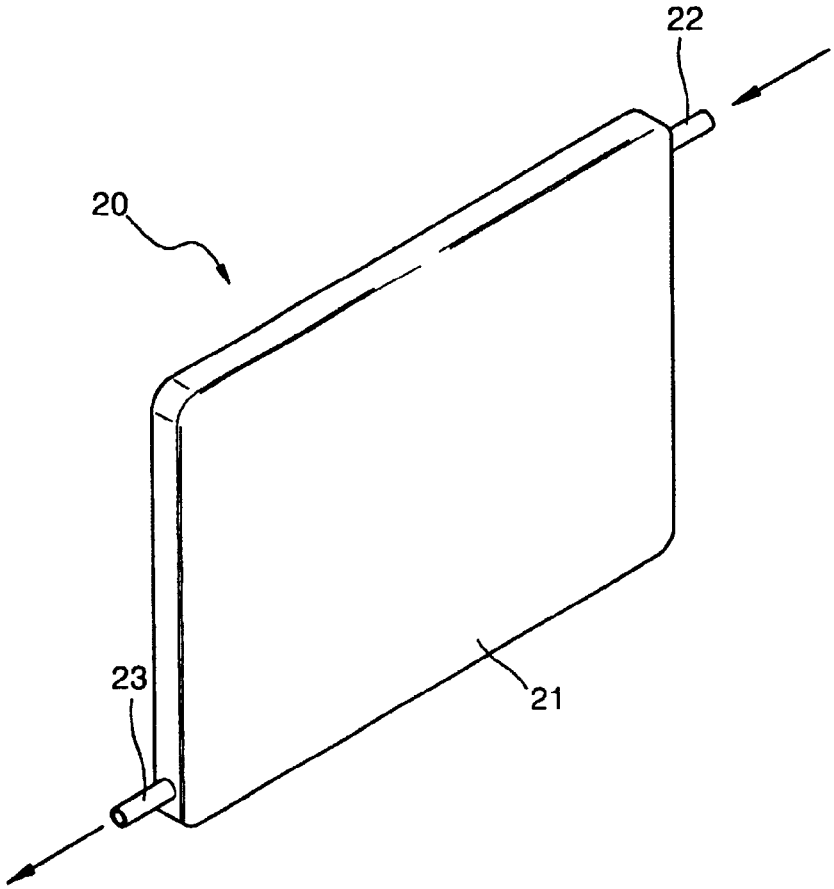
FIG. 2 (PRIOR ART)
FIG. 2 is a schematic perspective view of the exterior of a conventional plate type condenser.
Figure 3:
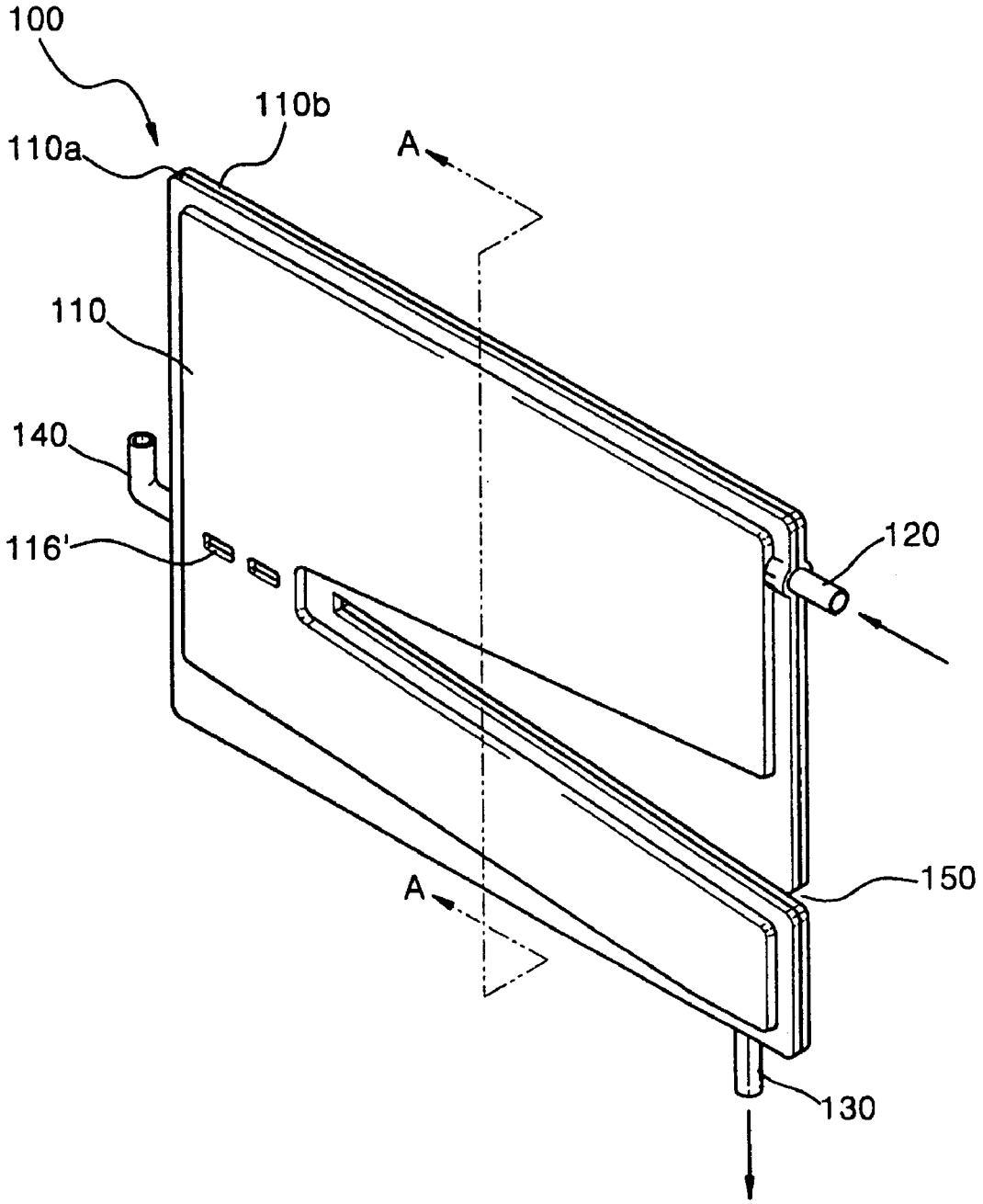
FIG. 3 is a perspective view of the exterior of a plate type condenser according to a first embodiment of the present invention.

Referring to FIGS. 3 through 4B, a plate type condenser 100 according to a first embodiment of the present invention includes a casing 110 inside of which an upper space 111, a lower space 112 and a connecting portion 113 are defined. The casing 110 has the shape of a thin plate and is formed of a material with excellent heat conductivity, for example, an aluminum plate or an aluminum alloy plate, in order to easily radiate heat from a refrigerant in the upper and lower spaces 111 and 112.

A refrigerant inlet 120 communicating with the upper space 111 is installed at one upper end of the casing 110. A refrigerant outlet 130 communicating with the lower space 112 is installed at one lower end of the casing 110. The refrigerant inlet 120 and the refrigerant outlet 130 can be disposed together at one end of the casing 110. This is preferable because the lengths of tubes connecting the refrigerant inlet 120 and the refrigerant outlet 130 to an evaporator not shown can be minimized.

The upper space 111 is provided for cooling a refrigerant, which had previously evaporated by absorbing heat from a heat source and now flows in through the refrigerant inlet 120. The lower space 112 is provided for accommodating a condensed liquid refrigerant. A liquid refrigerant is subcooled in the lower space 112. The subcooled liquid refrigerant is discharged through the refrigerant outlet 130 and then carried toward a heat source.

The connecting portion is a passage connecting the upper space 111 to the lower space 112 so that a liquid refrigerant produced in the upper space 111 can flow into the lower space 112. The connecting portion is provided between the upper space 111 and the lower space 112, and preferably, is provided at the boundary between a gaseous refrigerant and a liquid refrigerant. It is preferable for a plurality of holes 117 having a small diameter to be formed in the connecting portion in order to prevent a liquid refrigerant from flowing backward due to surface tension when the condenser 100 is overturned. The connecting portion is preferably disposed near an end opposite to the end of the casing 110 at which the refrigerant inlet 120 and the refrigerant outlet 130 are disposed. Accordingly, the flow path of a refrigerant from the refrigerant inlet 120 to the refrigerant outlet 130 through the connecting portion is long so that the refrigerant can be satisfactorily cooled in the condenser 100.

A refrigerant intake 140 through which a refrigerent is injected into the lower space 112 may be installed near the connecting portion of the casing 110. The refrigerant is lowered due to decrease in the amount of the liquid refrigerant.

As a feature of the present invention, a first adiabatic silt 150 for suppressing heat conduction from the upper space 111 to the lower space 112 is provided. The first adiabatic slit 150 extends from an edge 110*c* of the casing and generally toward the fluid connecting portion 113 and is formed by cutting off the walls 110*a* and 110*b* of the casing 110 between the upper space 111 and the lower space 112, except at the connecting portion. In order to prevent heat conduction in a range as wide as possible, the first adiabatic silt 150 is formed to be as long as possible, for example, the length of the first adiabatic slit 150 is preferably ¾ of the horizontal length of the casing 110. The first adiabatic slit 150 prevents heat radiated from a gaseous refrigerant in the upper space 111 from flowing into a liquid refrigerant in the lower space 112 through the walls 110*a* and 110*b* of the case 110 so that the liquid refrigerant can be subcooled in the lower space 112 in the condenser 100, that is, the condenser 100 additionally performs the function of a subcooler, a separate subcooler is not necessary.

An infrared photograph was taken to show the distribution of temperature in a plate type condenser in a normal state according to the first embodiment of the present invention. In the infrared image, temperature is relatively higher at bright portions (white or red portions in a color photograph) and relatively lower at dark portions (blue portions in the color photograph). The temperature is highest at the upper right portion of a condenser casing, that is, a portion at which a refrigerant inlet 120 is located, because a high temperature gaseous refrigerant flows into this portion. As a portion is farther from the refrigerant inlet 120 and closer to the refrigerant outlet 130, the temperature of the portion becomes lower. Particularly, the difference in temperature between upper and lower portions around the first adiabatic slit 150 is large. For example, the difference in temperature between upper and lower portions around the first adiabatic slit 150 at the right edge of the casing is about 15° C.

Hereinafter, the functions of the condenser 100 and the features of the members thereof according to the first embodiment of the present invention will be described in detail. Once a gaseous refrigerant which has absorbed the heat of a heat source flows into the upper space 111 of the casing 110, heat is radiated through the walls 110*a* and 110*b* of the casing 110 at both sides of the upper space 111. As a result, the gaseous refrigerant is cooled and condensed into a liquid. The liquid refrigerant flows into the lower space 112 through the via holes 117 of the connecting portion. Here, it is preferable that the bottom 113 of the upper space 111 descends toward the connecting portion, thereby allowing the liquid refrigerant to naturally flow toward the connecting portion.

The liquid refrigerant flowing into the lower space 112 runs from the connecting portion toward the refrigerant outlet 130. During this time, cooling is continuously accomplished because the conduction of heat from the upper space 111 is broken by the first adiabatic slit 150 so that the temperature of walls 110*a* and 110*b* of the casing 110 at both sides of the lower space 112 is maintained low. In addition, as described above, since the connecting portion is separated from the refrigerant outlet 130 at a maximum distance, the flow path of the liquid refrigerant is long, thereby accomplishing satisfactory cooling. It is preferable that the bottom 114 of the lower space 112 descends toward the refrigerant outlet 130 in order to allow the liquid refrigerant to naturally flow to the refrigerant outlet 130.

It takes some time to discharge the liquid refrigerant in the lower space 112 through the refrigerant outlet 130. During this time the liquid refrigerant is contained in the lower space 112, uncondensed gas contained in the liquid refrigerant is discharged, rises upward and flows into the upper space 111. Here, it is preferable that the top 115 of the lower space 112 ascends toward the connecting portion in order to allow the uncondensed gas to smoothly flow into the upper space 111. As the top 115 of the lower space slants at a predetermined angle, it is preferable that the first adiabatic slit 150 ascends from the one edge of the casing 110 toward the connecting portion.

The casing 110 of the condenser 100 according to the present invention as described above can be formed by press-molding two thin plates, for example, aluminum plates, using a roll bonding method. More specifically, two thin plates with a thickness of about 1 mm constituting both walls 110*a* and 110*b* of the casing 110 are brought into contact with each other and pressed at their edges and at a portion where the first adiabatic slit 150 will be formed. In this state, compressed air is injected between the two thin plates. Then portions which are not compressed swell out, thereby forming the upper space 111, the lower space 112 and the connecting portion. The swelling is controlled by a predetermined means outside such that the width of each of the upper space 111, the lower space 112 and the connecting portion becomes about 1–2 mm.

The holes 117 of the connecting portion are formed simultaneously with the upper space 111 and the lower space 112 or separately formed after the upper space 111 and the lower space 112 are formed. More specifically, the two thin plates are also pressed at predetermined intervals at a portion where the connecting portion will be formed, and then compressed air is injected as described above. As a result, recesses 116 are formed on the outside of the connecting portion, as shown in FIG. 3, and projections 116 are formed on the inside of the connecting portion. The spaces between the projections 116 form the holes 117.

As described above, the members of the condenser 100 according to the present invention can be simultaneously and integrally formed, thereby simplifying manufacturing processes and saving manufacturing costs.

Figure 5:
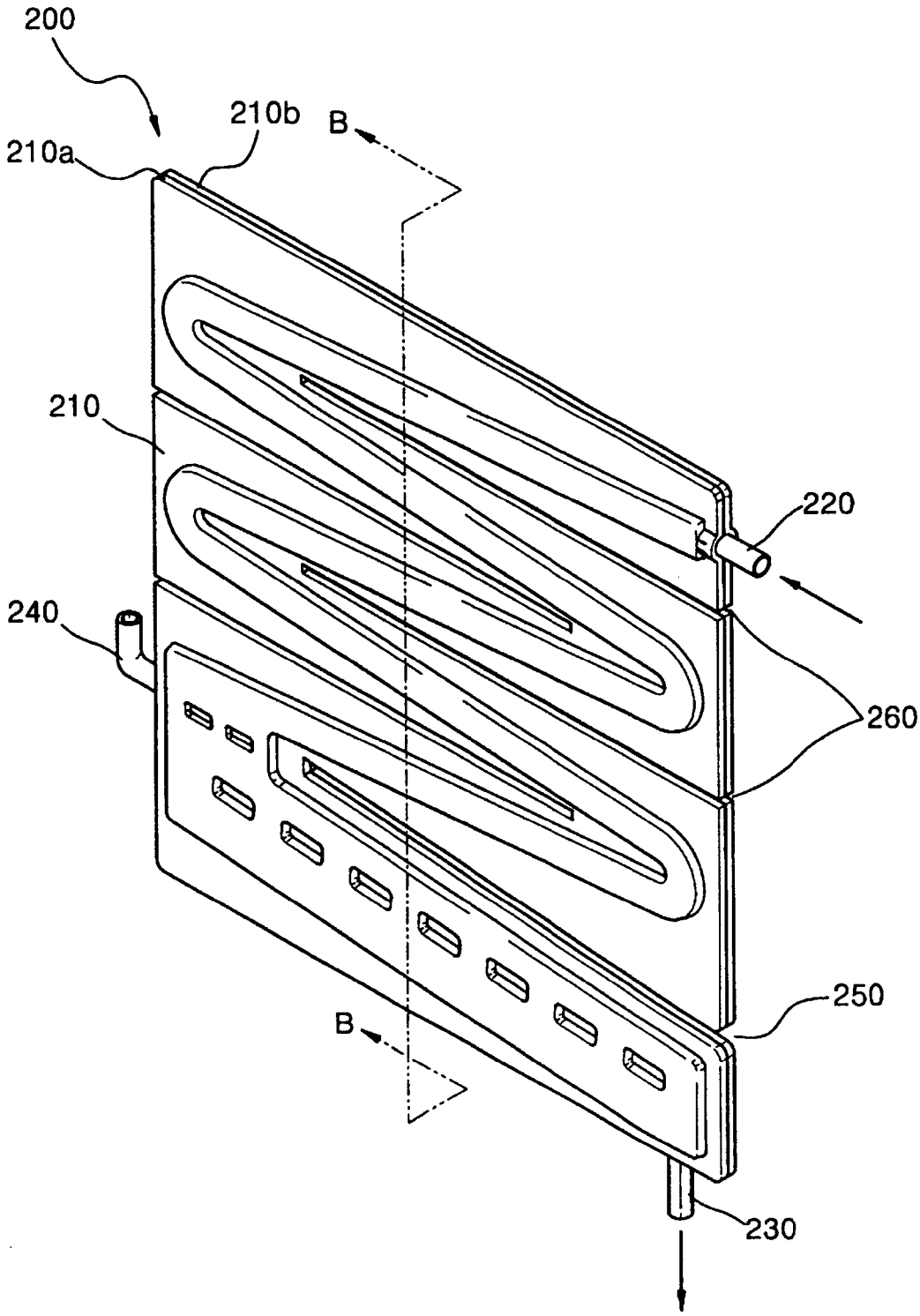
FIG. 5 is a perspective view of the exterior of a plate type condenser according to a second embodiment of the present invention.
Figure 6A:
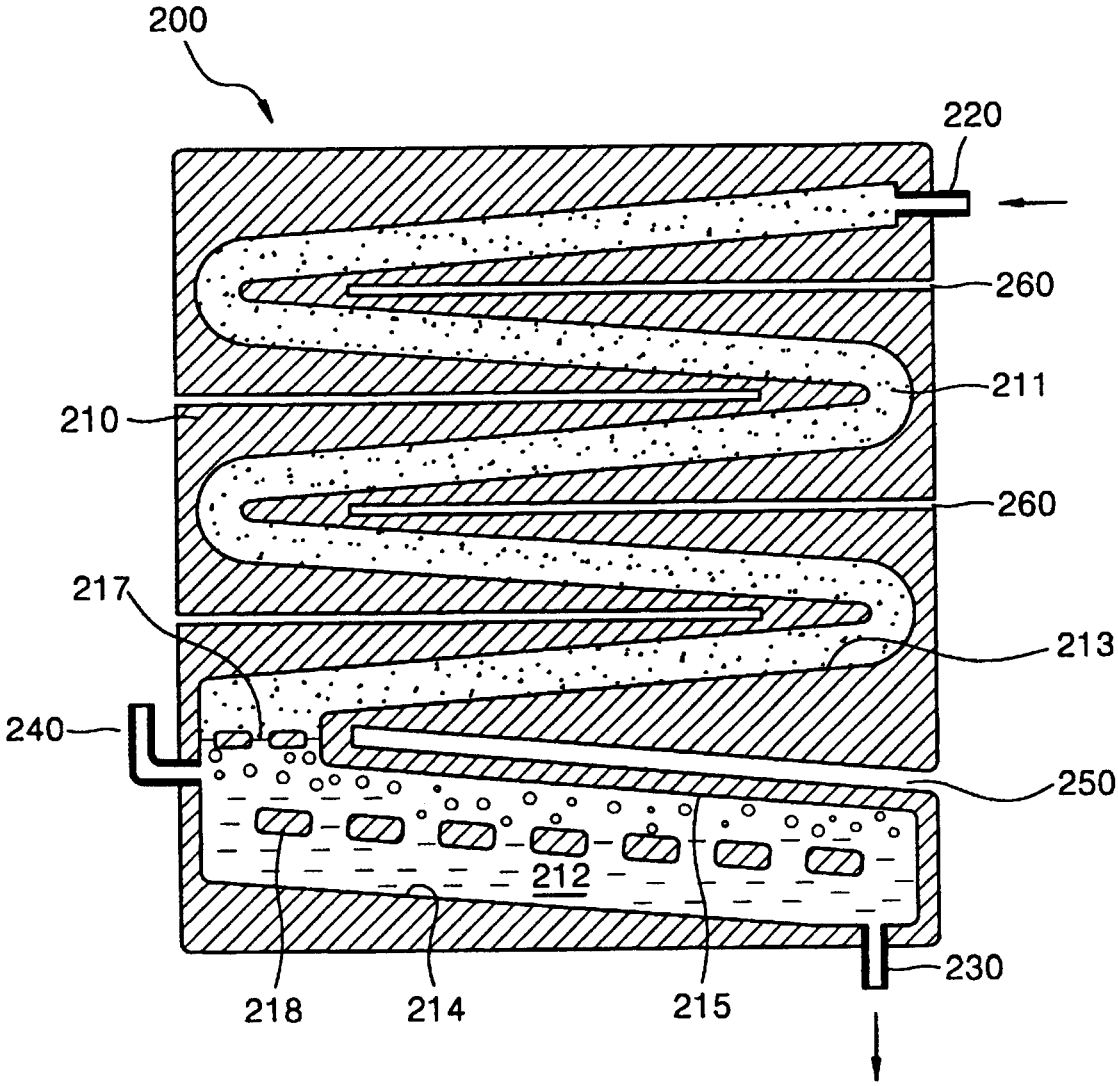
FIG. 6A is a coplanar sectional view of the plate type condenser of FIG. 5.
Figure 6B:
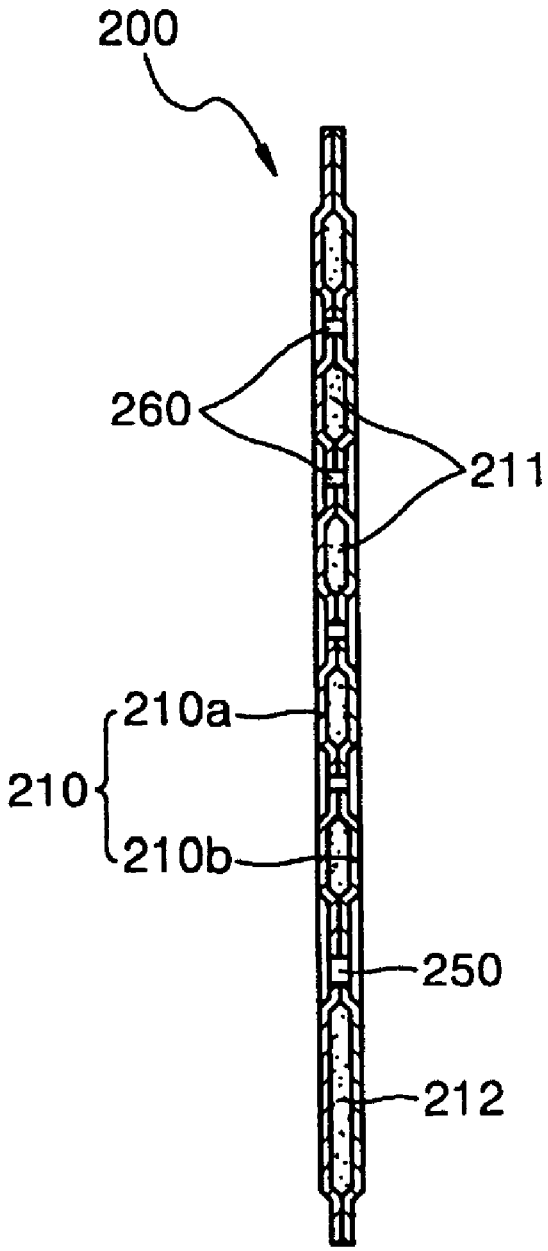
FIG. 6B is a vertical sectional view of the plate type condenser of FIG. 5, taken along the line B—B.

FIG. 5 is a perspective view of the exterior of a plate type condenser according to a second embodiment of the present invention. FIG. 6A is a coplanar sectional view of the plate type condenser of FIG. 5. FIG. 6B is a sectional view of the plate type condenser of FIG. 5, taken along the line B—B. Since the second embodiment is the same as the first embodiment in many respects, the following description will focus on the differences between the two embodiments.

Referring to FIGS. 5 through 6B, a casing 210 of a plate type condenser 200 according to the second embodiment defines a refrigerant path 211, a lower space 212 and a connecting portion therein. In this embodiment, the refrigerant path 211 is formed in a zig-zag from a refrigerant inlet 220 to the connecting portion in an upper space. Due to this shape of the refrigerant path 211, the flow path of a gaseous refrigerant becomes long enough to satisfactorily cool the gaseous refrigerant. A bottom 213 of the refrigerant path 211 is preferably formed to descend toward the connecting portion so that a condensed liquid refrigerant can naturally run to the connecting portion.

A second adiabatic slit 260 may be formed between one or more of the zig-zags of the refrigerant path 211. The second adiabatic slit 260 separates the wall of the casing 210 between the zig-zags of the refrigerant path 211. The temperature of a gaseous refrigerant gradually decreases while the gaseous refrigerant flows from the refrigerant inlet 220 through the refrigerant path 211 to a refrigerant outlet 230. Since the second adiabatic slit 260 suppresses the conduction of heat radiated from a high temperature portion to a low temperature portion through the wall of the casing 210, a greater temperature gradient can be established, and cooling performance can be enhanced.

Meanwhile, the refrigerant inlet 220, refrigerant outlet 302, holes 217 of the connecting portion, refrigerant intake 240, first adiabatic slit 250 and their functions are the same as in the first embodiment. Also, top 215 and bottom 214 of the lower space slat for the same reasons as in the first embodiment.

As in the first embodiment, the casing 210 of the condenser 200 of the second embodiment is formed by press-molding two thin plates forming both walls 210*a* and 210*b* thereof using a roll bonding method so that the members of the condenser 200 can be simultaneously and integrally formed. Here, the zig-zag refrigerant path 211 can be formed by injecting compressed air between the two thin plates in a state in which portions between the zig-zags of the refrigerant path 211 are pressed.

Meanwhile, the casing 210 may easily deform under external pressure because it is formed of thin plates, causing the width of the lower space 212 to decrease or the walls 210*a* and 210*b* of the casing 210 to partially contact each other in the lower space 212.

In this case, the flow of a liquid refrigerant in the lower space 212 is obstructed. To prevent this problem, it is preferable for a plurality of spacers 218 to be formed in the lower space 212 in order to maintain the width of the casing 210 regular in the lower space 212. The spacers 218 can be formed by pressing the outside of the walls of the casing 210 at portions to be made into spacers 218 and then injecting compressed air into the casing 210.

Figure 7:
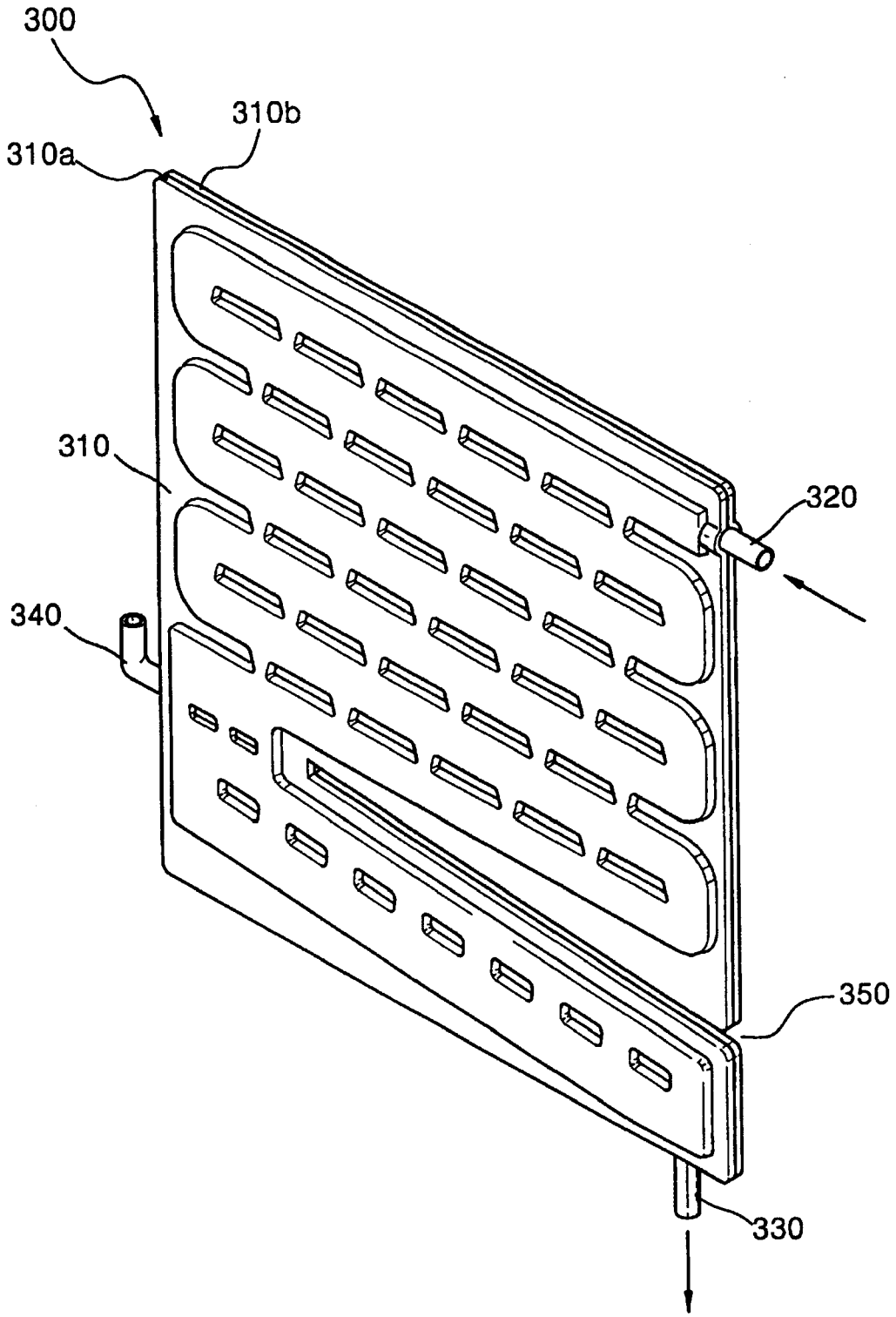
FIG. 7 is a perspective view of the exterior of a plate type condenser according to a third embodiment of the present invention.
Figure 8:
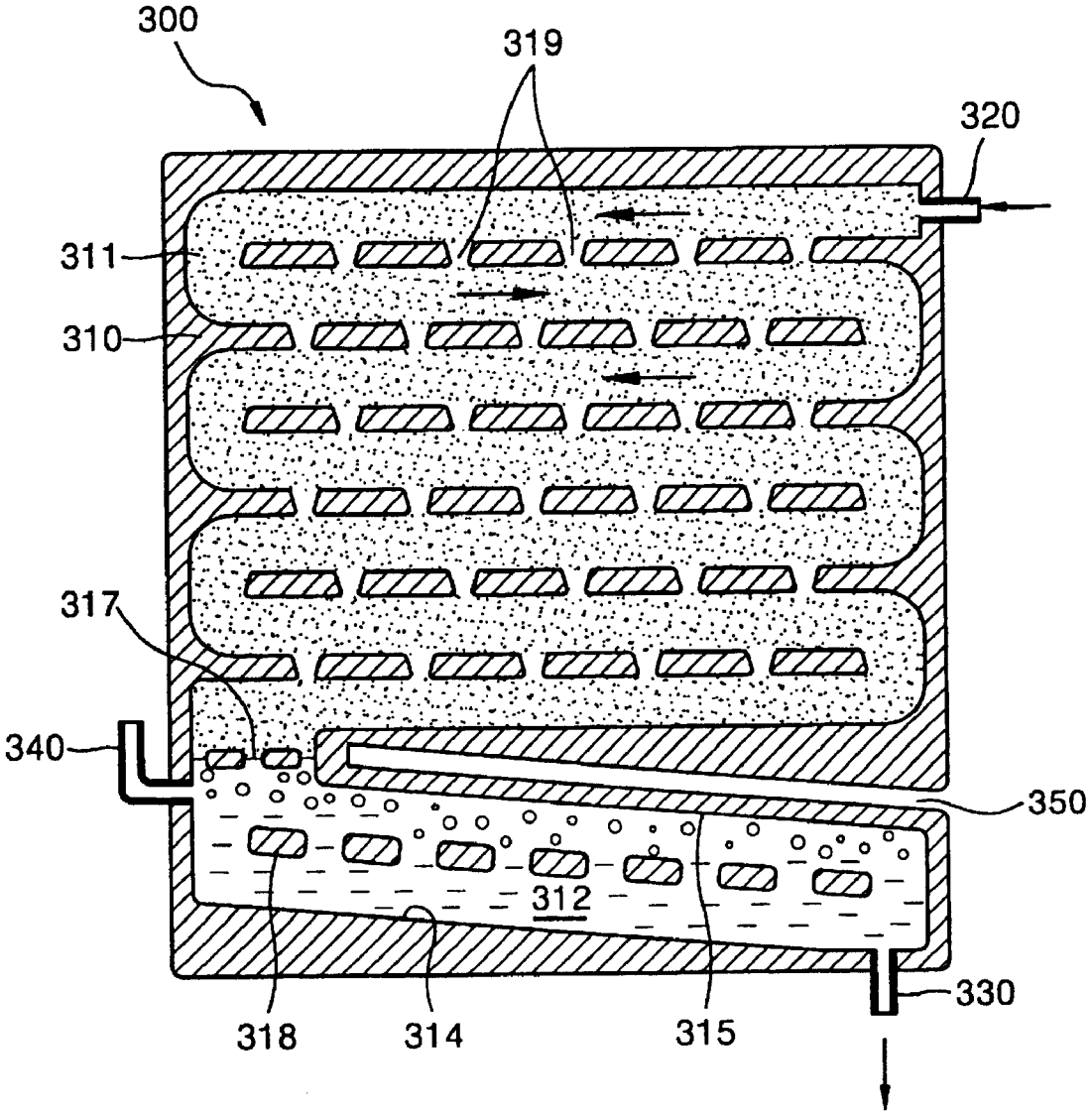
FIG. 8 is a coplanar sectional view of the plate type condenser of FIG. 7.

FIG. 7 is a perspective view of the exterior of a plate type condenser according to a third embodiment of the present invention, and FIG. 8 is a coplanar sectional view of the plate type condenser of FIG. 7. Since the third embodiment is the same as the first and second embodiments in many respects, the following description will focus on the different features of the third embodiment.

Referring to FIGS. 7 and 8, a casing 310 of a plate type condenser 300 according to the third embodiment defines a refrigerant path 311, a lower space 312 and a connecting portion therein. In this embodiment, the refrigerant path 311 is formed to wind back and forth from a refrigerant inlet 320 to the connecting portion in an upper space. Due to this shape of the refrigerant path 311, as described above, the flow path of a gaseous refrigerant becomes long enough to satisfactorily cool the gaseous refrigerant.

In this embodiment, a plurality of vertical passages 319 can be formed between the adjacent upper and lower portions of the refrigerant path 311 in a vertical direction. The plurality of vertical passages 319 are disposed at predetermined intervals and can be disposed to alternate with each other in the vertical direction. It is preferable to form each vertical passage 319 to have a funnel-shaped cross section in which a upper portion is wider than a lower portion so that a liquid refrigerant can be easily gathered at the vertical passages 319. The vertical passages 319 are also formed to be very narrow but wide enough to easily pass a liquid refrigerant so that the flow direction (represented by larger arrows in FIG. 8) of a gaseous refrigerant within the refrigerant path 311 is not influenced. The vertical passages 319 having such a structure allow liquid refrigerant to easily drop and be gathered in the lower space 312. Accordingly, problems such as the refrigerant path 311 being blocked up by liquid refrigerant and the effective cross sectional area of the refrigerant path 311 decreasing can be prevented. Instead of the vertical passages 319, a second adiabatic slit may be formed between the adjacent upper and lower portions of the refrigerant path 311, as described above.

The refrigerant inlet 320, refrigerant outlet 330, holes 317 of the connecting portion, refrigerant intake 340, spacer 318, first adiabetic slit 350, and their functions are the same as in the first or second embodiment. Also, top 315, and bottom 314 of the lower space slant for the same reasons as n the first and second embodiments.

Like the first and second embodiments, the casing 310 of the condenser 300 according to the third embodiment is formed by press-molding two thin plates forming both walls 310*a* and 310*b* thereof using a roll bonding method so that the members of the condenser 300 can be simultaneously and integrally formed.

As described above, a plate type condenser according to the present invention has the following advantages. First, since an upper space and a lower space are separated from each other by a first adiabatic slit, heat radiated from a gaseous refrigerant within the upper space is prevented from being conducted to a liquid refrigerant within the lower space through the walls of a casing, so that the liquid refrigerant within the lower space can be satisfactorily cooled. In addition, uncondensed gas contained in the liquid refrigerant within the lower space can be substantially discharged. Consequently, a condenser according to the present invention functions as both a subcooler and a reservoir. Therefore, the entire volume of a cooling system using a condenser according to the present invention can be reduced so that the cooling system can be easily adapted to fit in narrow spaces of dense electronic equipment. Second, due to a hole formed in a connecting portion connecting the upper space to the lower space, the backward flow of a refrigerant can be prevented even when the condenser is overturned. Third, the casing defining the upper and lower spaces and the connecting portion can be formed by press-molding two thin plates, and the other members of the condenser can be integrally formed with the casing, thereby simplifying manufacturing process and saving manufacturing costs.

Although the invention has been described with reference to particular embodiments thereof, it will be apparent to one of ordinary skill in the art that modifications to the described embodiments may be made without departing from the spirit and scope of the invention. Therefore, the true technical scope of the present invention will be defined by the attached claims.

What is claimed is:

1. A plate type condenser comprising:

a casing defining an upper space in which a gaseous refrigerant flows and is cooled, a lower space for accommodating a liquid refrigerant into which the gaseous refrigerant is condensed, and a connecting portion through which the upper and lower spaces communicate with each other, the casing substantially having a plate shape;

a refrigerant inlet through which the gaseous refrigerant flows into the upper space, the refrigerant inlet being installed at an upper portion of the casing to communicate with the upper space;

a refrigerant outlet through which the liquid refrigerant in the lower space is discharged, the refrigerant outlet being installed at a lower portion of the casing to communicate with the lower space; and a first adiabatic slit for separating the walls of the casing between the upper space and the lower space except at the connecting portion, in order to suppress heat conduction from the upper space to the lower space;

wherein the top of the lower space ascends toward the connecting portion.

2. The plate type condenser of claim 1, wherein the upper space is a refrigerant path formed in zig-zag from the refrigerant inlet to the connecting portion.

3. The plate type condenser of claim 1, wherein the upper space is a refrigerant path which winds back and forth from the refrigerant inlet to the connecting portion.

4. The plate type condenser of claim 2, wherein a second adiabatic slit for separating the walls of the casing is formed between at least one pair of adjacent upper and lower portions of the refrigerant path.

5. The plate type condenser of claim 3, wherein a plurality of vertical passages are formed between adjacent upper and lower portions of the refrigerant path substantially in a vertical direction so that the liquid refrigerant produced within the refrigerant path can drop.

6. The plate type condenser of claim 1, wherein the cross-section of each vertical passage has a funnel shape in which an upper portion is wider than a lower portion.

7. The plate type condenser of claim 1, wherein the refrigerant inlet and the refrigerant outlet are disposed at the same end of the casing.

8. The plate type condenser of claim 7, wherein the connecting portion is disposed near an end of the casing opposite to the end at which the refrigerant inlet and the refrigerant outlet are disposed.

9. The plate type condenser of claim 1, wherein the first adiabatic slit ascends from one of the casing toward the connection portion.

10. The plate type condenser of claim 1, wherein the bottom of the upper space descends toward the connecting portion.

11. The plate type condenser of claim 1, wherein the bottom of the lower space descends toward the refrigerant outlet.

12. The plate type condenser of claim 1, wherein a refrigerant intake through which a refrigerant is injected into the lower space is installed at the casing.

13. The plate type condenser of claim 1, wherein a plurality of holes are formed in the connecting portion.

14. The plate type condenser of claim 1, wherein a plurality of spacers for maintaining the width of the lower space constant are formed in the lower space.

15. The plate type condenser of claim 1, wherein the horizontal length of the first adiabatic slit is at least ¾ of the horizontal length of the casing.

16. The plate type condenser of claim 1, wherein the casing is formed by press-molding, roll-bonding, or brazing two thin plates such that the upper space, the lower space and the connecting portion can be formed between the two thin plates.

17. The plate type condenser of claim 1, wherein the casing is formed of a heat conductive material.

18. The plate type condenser of claim 17, wherein the heat conductive material is aluminum or aluminum alloy.

19. A plate type condenser comprising:

a casing defining an upper space in which a gaseous refrigerant flows and is cooled, a lower space for accommodating a liquid refrigerant into which the gaseous refrigerant is condensed, and a connecting portion through which the upper and lower space communicate with each other, the casing substantially having a plate shape;

a refrigerant inlet through which the gaseous refrigerant flows into the upper space, the refrigerant inlet being installed at an upper portion of the casing to communicate with the upper space;

a refrigerant outlet through which the liquid refrigerant in the lower space is discharged, the refrigerant outlet being installed at a lower portion of the casing to communicate with the lower space; and a first adiabatic slit for separating the walls of the casing between the upper space and the lower space except at the connection portion, in order to suppress heat conduction from the upper space to the lower space;

wherein the upper space is a refrigerant path which winds back and forth from the refrigerant inlet to the connecting portion; and a plurality of vertical passages are formed between adjacent upper and lower portions of the refrigerant path substantially in a vertical direction so that the liquid refrigerant produced within the refrigerant path can drop.

20. A plate type condenser comprising:

a casing defining an upper space in which a gaseous refrigerant flows and is cooled, a lower space for accommodating a liquid refrigerant into which the gaseous refrigerant is condensed, and a connecting portion through which the upper and lower spaces communicate with each other, the casing substantially having a plate shape;

a refrigerant inlet through which the gaseous refrigerant flows into the upper space, the refrigerant inlet being installed at an upper portion of the casing to communicate with the upper space;

a refrigerant outlet through which the liquid refrigerant in the lower space is discharged, the refrigerant outlet being installed at a lower portion of the casing to communicate with the lower space; and a first adiabatic slit for separating the walls of the casing between the upper space and the lower space except at the connecting portion, in order to suppress heat conduction from the upper space to the lower space;

wherein a refrigerant intake through which a refrigerant is injected into the lower space is installed at the casing.

* * * * *